US009479874B2

(12) United States Patent
Shikimachi et al.

(10) Patent No.: US 9,479,874 B2
(45) Date of Patent: Oct. 25, 2016

(54) SPEAKER AND EDGE STRUCTURE THEREOF

(71) Applicant: DB TECHNOLOGY CO, LTD., Osaka-shi, Osaka (JP)

(72) Inventors: Bunjiro Shikimachi, Osaka (JP); Hajime Imada, Osaka (JP)

(73) Assignee: DB TECHNOLOGY CO., LTD (JP)

( * ) Notice: Subject to any disclaimer, the term of this patent is extended or adjusted under 35 U.S.C. 154(b) by 175 days.

(21) Appl. No.: 14/405,090

(22) PCT Filed: Dec. 6, 2013

(86) PCT No.: PCT/JP2013/082786

§ 371 (c)(1),
(2) Date: Dec. 2, 2014

(87) PCT Pub. No.: WO2014/199531

PCT Pub. Date: Dec. 18, 2014

(65) Prior Publication Data

US 2016/0277839 A1 Sep. 22, 2016

(30) Foreign Application Priority Data

Jun. 10, 2013 (JP) ..... 2013-121929

(51) Int. Cl.

| | |
|---|---|
| ***H04R 9/00*** | (2006.01) |
| ***H04R 7/18*** | (2006.01) |
| ***H04R 9/06*** | (2006.01) |
| ***H04R 9/02*** | (2006.01) |
| ***H04R 1/28*** | (2006.01) |

(52) U.S. Cl.

CPC ..... *H04R 7/18* (2013.01); *H04R 1/2834* (2013.01); *H04R 9/025* (2013.01); *H04R 9/06* (2013.01); *H04R 2307/207* (2013.01)

(58) Field of Classification Search

CPC ..... H04R 9/00
USPC ..... 381/398, 396
See application file for complete search history.

(56) References Cited

U.S. PATENT DOCUMENTS 5,574,797 A * 11/1996 Geisenberger ..... H04R 7/20 381/398
5,687,247 A * 11/1997 Proni ..... H04R 31/006 381/398

(Continued)

FOREIGN PATENT DOCUMENTS

| | | |
|---|---|---|
| JP | 07111689 | 4/1995 |
| JP | 10294992 | 11/1998 |
| JP | 2000217192 | 8/2000 |
| JP | 2003125485 | 4/2003 |
| JP | 2008118331 | 5/2008 |

(Continued)

*Primary Examiner* — Suhan Ni
(74) *Attorney, Agent, or Firm* — Perman & Green, LLP

(57) ABSTRACT

An edge for a speaker making it possible to decrease a thickness of the speaker and achieve cost reduction by using no damper without lowering a sound quality is provided. The edge of a speaker is in a sheet-like and ring form and includes an outer fixing part formed on its outer peripheral part for fixing the edge to the frame (supporting member), an inner fixing part formed on its inner peripheral part for fixing the edge to the diaphragm, and a sheet-like part lying between the inner fixing part and the outer fixing part (connecting the inner fixing part and the outer fixing part). The respective convex portions are formed at least on both surfaces of the sheet-like part at the boundary portion of the sheet-like part and the outer fixing part, thereby forming the control parts for controlling the vibration of the diaphragm.

8 Claims, 4 Drawing Sheets

(56) References Cited

U.S. PATENT DOCUMENTS

| | | | | |
|---|---|---|---|---|
| 6,782,114 | B2 * | 8/2004 | Ando | H04R 7/20 381/398 |
| 2001/0011615 | A1 | 8/2001 | Iwasa et al. | |

FOREIGN PATENT DOCUMENTS

| | | |
|---|---|---|
| JP | 2009164676 | 7/2009 |
| JP | 2010154178 | 7/2010 |
| JP | 2012065157 | 3/2012 |

* cited by examiner

SPEAKER AND EDGE STRUCTURE THEREOF

CROSS-REFERENCE TO RELATED APPLICATIONS

This application is the National Stage of International Application No. PCT/JP2013/082786 having International Filing Date, 6 Dec. 2013, which designated the United States of America, and which claims priority from, and the benefit of, Japanese Application No. 2013-121929, filed on 10 Jun. 2013, the disclosures of which are incorporated herein by reference in their entireties.

BACKGROUND

1. Field

The presently disclosed embodiment relates to a speaker including a speaker having a drive mechanism and a passive radiator type speaker, and an edge structure thereof, in particular to an edge having a structure enabling an excessive amplitude of vibration of a diaphragm to be inhibited only with the edge by providing a control part on the edge without using a damper, and to a speaker using the edge.

2. Brief Description of Related Developments

Conventional speakers have, for example, a structure as shown in FIG. 6A. Namely, in FIG. 6A, an outer peripheral end of a diaphragm 2 made of, for example, a cone paper is fixed to an inner peripheral end of an edge 10, an outer peripheral end of which is fixed to a frame 6, and an inner peripheral end of the diaphragm 2 is fixed to an outer circumference of a bobbin 3. A voice coil 4 for flowing a sound current is wound around a bottom end side of an outer circumference of the bobbin 3, and a magnetic field is generated on the voice coil 4 by electromagnetic induction caused by a change in the sound current flowed in the voice coil 4, and by an interaction between the magnetic field and a static magnetic field generated previously by a magnetic circuit 7 comprising a permanent magnet 7*a* and a yoke 7*b*, the voice coil 4 and the bobbin 3 are vibrated and then the diaphragm 2 is vibrated, thereby vibrating air to generate a sound. In this case, if an amplitude of the vibration of the bobbin 3 is too large, the amplitude further increases due to an inertia and does not follow the change in the sound current. Therefore, a damper 8 is provided as a control part for controlling the amplitude of the vibration. This damper 8 is connected between the frame 6 and the outer circumference of the bobbin 3, and is configured so that too much movement of the diaphragm in a vertical direction is inhibited. Numeral 5 represents a dust cap.

This damper 8 is produced using a prepreg substrate produced by impregnating a woven fabric made of a cotton yarn, an aramid fiber, or the like with a resin such as a phenolic resin or a melamine resin, and the prepreg substrate is subjected to heating and molding in a mold to be formed into a corrugated shape as shown in FIG. 6A. On the other hand, as shown in an enlarged view of FIG. 6B, the edge 10 is formed into an arc shape and supports the diaphragm 2 to allow it to be easily vibrated freely. The thickness of the edge is uniform and the edge is formed so as to be vibrated freely.

SUMMARY

As mentioned above, in usual speakers, an excessive vibration of a diaphragm is inhibited by disposing a damper as a control part between a bobbin and a frame. However, in order to make a speaker thin, it is necessary not to use a damper from a structural point of view. Further as mentioned above, the damper must be produced by subjecting the prepreg substrate produced by impregnating a cotton yarn or the like with a resin to molding in a mold, which leads to increase in cost, and therefore, further cost reduction is demanded.

On the other hand, if a damper is not used, there is no control part for inhibiting an excessive vibration of a diaphragm, which causes a problem that control of a diaphragm is not performed sufficiently and sound quality is lowered.

The presently disclosed embodiment was made in the light of the above-mentioned situation, and an object of the presently disclosed embodiment is to provide an edge structure provided with a control part which enables a speaker to be made thin and cost reduction to be achieved without lowering sound quality by removing a damper.

The inventors of the presently disclosed embodiment have made extensive studies in order not to lower sound quality of a speaker even if a damper is not provided, and as a result, have found that an excessive vibration of a diaphragm can be inhibited and thus vibration of a diaphragm can be controlled with an edge by forming an outer peripheral end and an inner peripheral end of the edge into shapes so as to inhibit an excessive amplitude of the vibration of the diaphragm when a large amplitude of the vibration occurs due to the vibration of the diaphragm, namely by making a thickness of end sides of the sheet-like edge thicker than its center portion or by forming the sheet-like edge so as to have a convex portion on either surface thereof.

Here, the convex portion means that, for example, a protruded portion may be formed, or even if the protruded portion is not formed, either surface of the edge may be formed into a convex arc or a concave arc. Namely, in the case of a convex arc, since a bending action to be applied toward the outer surface of the convex is inhibited, vibration in this direction can be controlled. Also, even in the case where one surface of a sheet-like edge is formed into a concave arc, when viewing the inside of the concave shape, it is in a convex shape, and therefore, when the edge vibrates toward the outside when viewing from the inside of the concave shape, there is an action for inhibiting the bending. In other words, for example, as shown in FIG. 4 to be explained infra, in the case of the edge being in a sheet-like form and having concave arc shapes formed on both surfaces thereof, when the amplitude of the vibration of the diaphragm acts downward, the concave portion of the top surface of the edge acts so as to inhibit the downward amplitude, and when the amplitude acts upward, the concave portion of the bottom surface of the edge acts so as to inhibit the upward amplitude. Namely, the concave portion of the top surface is a convex portion when viewing from the upper side in FIG. 4, and the concave portion of the bottom surface is a convex portion when viewing from the lower side. These concave portions correspond to the convex portion specified in the presently disclosed embodiment.

The edge of the speaker of the presently disclosed embodiment is an edge of a speaker which is in a sheet-like and ring form and is disposed between a diaphragm and a frame of the speaker for fixing the diaphragm to the frame (a supporting member), and the edge comprises an outer fixing part formed on an outer peripheral part for fixing the edge to the frame, an inner fixing part formed on an inner peripheral part for fixing the edge to the diaphragm, and a sheet-like part connecting the inner fixing part and the outer fixing part, wherein the sheet-like part has the thinnest part in a cross-section thereof between the inner fixing part and the outer fixing part and is formed in such a manner that the thickness of the sheet-like part increases continuously in directions from the thinnest part to the inner fixing part and the outer fixing part, respectively; the sheet-like part has a semi-circular arc shape in its cross-section; in a boundary portion between the sheet-like part and the outer fixing part, the boundary portion is formed in such a manner that a surface of a convex side of the sheet-like part in the form of arc leads to a vertical surface of the outer fixing part at a higher point of the vertical surface and that a surface opposite to the convex side extends in parallel with the vertical surface of the outer fixing part to form a protruded portion and is in the same level as the bottom surface of the outer fixing part, or the surface opposite to the convex side is formed into reverse arc shape to the arc shape of the convex side (having a radial direction reverse to that of the arc shape of the convex side) and leads to the outer fixing part, and thus a control part for controlling vibration of the diaphragm is formed at least at the boundary portion between the sheet-like part and the outer fixing part.

In a boundary portion between the sheet-like part and the inner fixing part, both of arc shapes of the surface of the convex side and the surface opposite to the convex side are reverse arc shape to the arc shape of the sheet-like part and a radius of the reverse arc shape is smaller than that of the arc of the sheet-like part.

A boundary portion of the sheet-like part and the inner fixing part is formed in a reverse arc shape being reverse to the semi-circular shape of the sheet-like part and having a smaller radius than that of the arc of the sheet-like part, the reverse arc shape and the semi-circular shape forming an S-shape, the thinnest part is formed substantially at the center of the semi-circular arc shape, and the boundary portion of the sheet-like part and the inner fixing part is formed being bent with the arc having the smaller radius.

In another example, the edge of the speaker of the presently disclosed embodiment is in a sheet-like and ring form and is disposed between a diaphragm of the speaker and a frame for fixing the diaphragm to the frame, and comprises an outer fixing part formed on an outer peripheral part for fixing to the frame, an inner fixing part formed on an inner peripheral part for fixing to the diaphragm, and a sheet-like part connecting the inner fixing part and the outer fixing part, wherein the sheet-like part comprises a first arc portion, a second arc portion and a connecting portion, one end of each of the first arc portion and the second arc portion is defined as a thin part, and the first arc portion and the second arc portion are formed so as to be in arc shapes in such a manner that the thickness thereof increases continuously in directions from the thin part to the other ends, respectively, the other ends of the surfaces of the convex sides of the arc shapes are bent in an arc shape having a small radius and being a reverse shape to each of the arc shapes, respectively, the connecting portion leads to the respective one ends of the first arc portion and the second arc portion so that the arc shapes of the first arc portion and the second arc portion face toward reverse directions, and the other ends of the first arc portion and the second arc portion lead to the outer fixing part and the inner fixing part, respectively.

The speaker of the presently disclosed embodiment comprises a bobbin, a voice coil wound on the outer circumference of the bobbin, a magnetic circuit generating a magnetic field in a center portion of the voice coil, a frame provided outside the bobbin, an edge, an outer fixing part of which is fixed to the frame, and a diaphragm, an outer peripheral end of which is fixed to an inner fixing part of the edge, and a bobbin which is fixed to a back surface of the diaphragm or an inner peripheral end of the diaphragm formed in a form of ring, wherein the edge is one as described above.

Further, the speaker of the presently disclosed embodiment is a passive radiator type speaker comprising; a frame, an edge, an outer fixing part of which is fixed to the frame, and a diaphragm, an outer peripheral end of which is fixed to an inner fixing part of the edge, wherein the edge is one as described above.

According to the presently disclosed embodiment, the edge is formed so that a thickness of the edge of ring shape in a radial direction is thin substantially around a center thereof and increases continuously toward both ends thereof (an inner peripheral end and an outer peripheral end), and therefore, resistance to bending at the both ends of the edge, particularly at the outer peripheral end becomes large and the edge can serve fully as a control part for controlling vibration of the diaphragm. Namely, since the thicknesses of the inner peripheral end and the outer peripheral end of the edge formed in a sheet-like and ring shape are thick, resistance to bending becomes large and the excessive amplitude of the vibration of the diaphragm, namely bending of the edge can be inhibited. It is a matter of fact that usual small vibration is not blocked by the bending of the thin portion at the center of the edge, but even if a bending force larger than that of the thin portion is applied at a large amplitude, the vibration can be controlled at the ends such as the outer peripheral end. As a result, even if a damper is not used, the edge can surely respond to the amplitude of the diaphragm due to continuing vibration, and serves as a control part for inhibiting an excess vibration of the diaphragm. Therefore, according to the presently disclosed embodiment, a damper is not necessary, and a thickness of a speaker can be made thin and in addition, since an expensive damper is not necessary, cost reduction of the speaker can be achieved.

Since the above-mentioned control part of the edge inhibits an excessive amplitude of the vibration by controlling the bending of the edge, it is sufficient enough to only increase the thickness of the edge for allowing the edge to serve as a control part, and from the viewpoint of making the edge hardly bend, the structure of the edge may be such that a convex portion is formed on its end sides. As mentioned above, the convex portion may be a protruded portion or a convex or concave arc may be formed on a surface of a sheet-like part. Even in the case of a concave arc, there is not so large resistance against the bending toward the concave, but generally a large resistance acts against the bending toward the direction opposite to the bending toward the concave. Namely, an action for inhibiting the excessive amplitude of the vibration toward the direction opposite to the bending toward the concave is exhibited. Since the diaphragm vibrates vertically, it is necessary to inhibit the bending toward the both directions but not only the bending toward one direction. For that purpose, particularly at the outer fixing part, it is preferable that a control part for inhibiting the bending toward the both surfaces is formed, and it is preferable that the convex portions are formed on both sides using both surfaces.

In this case, if the edge is thickened outward on the both surfaces thereof, an elastic force of the edge itself decreases, and the vibration of the diaphragm is inhibited excessively. Therefore, it is necessary to form a control part for inhibiting a predetermined force or more at the end side of the edge without making the thickness of the edge so large in order not to generate too excessive inhibition and to enable excessive the amplitude of the vibration to be controlled.

From this point of view, when the edge is formed as shown in FIG. 4, the structure thereof is simple and since the convex portions facing toward the different directions are formed on both surfaces, excessive vibration can be inhibited in both directions.

Further, according to the speaker of the presently disclosed embodiment, an excessive vibration of the diaphragm can be inhibited only by the edge and therefore a damper is not necessary, a very low cost is ensured and a speaker with a very thin thickness having good performance can be obtained.

DETAILED DESCRIPTION

Figure 1A:
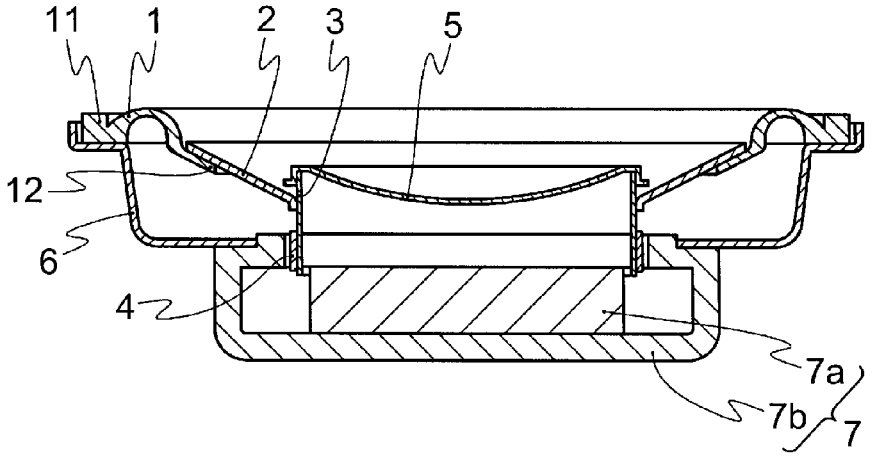
FIG. 1A is a cross-sectional view illustrating one aspect of the speaker of the presently disclosed embodiment.

Next, the speaker of the presently disclosed embodiment and its edge are explained by referring to the drawings. The edge of the speaker of the presently disclosed embodiment, as shown in a perspective view and a cross-sectional view of one aspect thereof in FIGS. 1B and 1C, respectively, is formed in the sheet-like and ring shape and comprises an outer fixing part 11 formed on an outer peripheral part for fixing to the frame (supporting member) 6, an inner fixing part 12 formed on an inner peripheral part for fixing a diaphragm 2, and a sheet-like part 13 connecting the outer fixing part 11 and the inner fixing part 12. On both surfaces of the sheet-like part 13 at least at the boundary portion of the sheet-like part 13 and the outer fixing part 11, the respective convex portions for controlling the bending are formed, thereby forming control parts S1, S2 for controlling vibration of the diaphragm 2. Further, the sheet-like part 13 also has a thinnest part A in its cross-section between the inner fixing part 12 and the outer fixing part 11 and may be formed in such a manner that the thickness of the sheet-like part 13 increases continuously in directions from the thickness t1 of the thinnest part A up to the thicknesses t2 and t3 at the outer fixing part 11 side and the inner fixing part 12 side, respectively, thereby being able to form the control parts for controlling vibration of the diaphragm 2 at least at the boundary portion of the sheet-like part 13 and the outer fixing part 11. Otherwise, the structure of the edge may be combination of these control parts S1 to S3 formed by changing the thicknesses of the sheet-like part with the above-mentioned control parts S1, S2 formed by forming the convex portions.

Figure 1B:
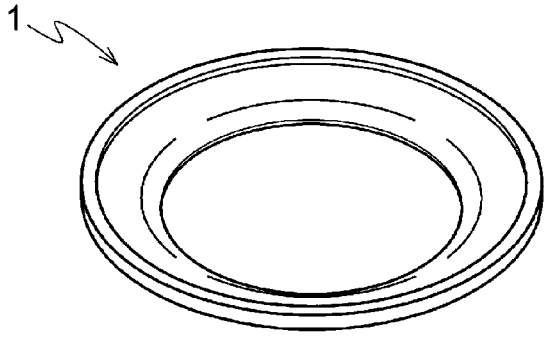
FIG. 1B is a perspective view of an edge of the speaker of FIG. 1A.
Figure 1C:
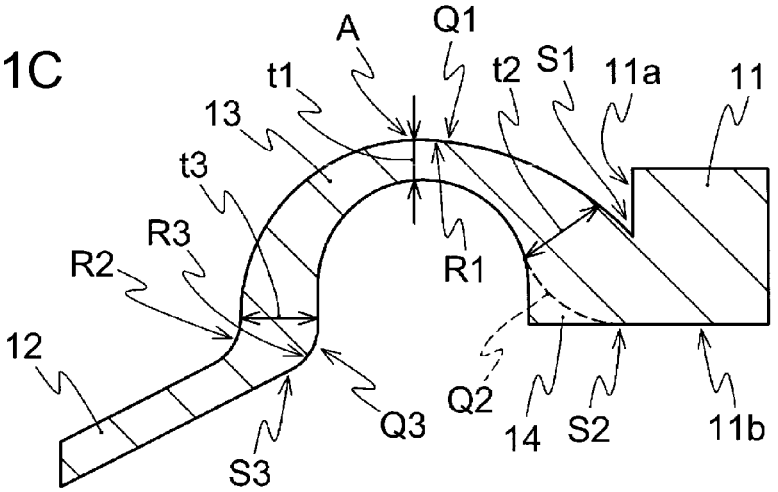
FIG. 1C is a cross-sectional view of an edge of the speaker of FIG. 1A.

The control parts S1 to S3 can be formed not only by increasing the thickness of the sheet-like part but also by forming the convex portions (an arc portion Q2, and a convex portion having a radius of R3) curved in the form of arc and a protruded portion 14 as shown in FIG. 1C. In the example shown in FIGS. 1A to 1C, the control parts S1 to S3 are formed by making the sheet-like part thicker at the both ends thereof and providing the convex portions. This combination use of the increased thickness and the convex portions is preferable since the control parts having desired control characteristics can be easily formed. For example, only by increasing the thickness, even normal vibration is inhibited and it is difficult to inhibit only an excessive vibration, thereby making it unable to carry out sufficient control. However, in addition to increasing slightly in the thickness, by forming the convex portions, it is easy to control the vibration in such an extreme case. When the vibration is controlled only by the convex portions, it is difficult to control the vibration at a medium amplitude and also the sheet-like part at the boundary portion between the convex portion and the outer fixing part is easily deformed. Therefore, these problems need to be solved and in order to do so, there is difficulty in production.

The reason for forming the control parts by increasing the thickness of the sheet-like part 13 at the both ends thereof is such that as the thickness is increased, rigidity increases and bending by a bending force hardly occurs, thereby making it possible to control the vibration. Meanwhile, when the whole thickness is increased, the vibration of the diaphragm 2 is inhibited and a function of the diaphragm 2 is blocked. Therefore, it is preferable to increase the thickness in the proximity of the fixing parts. Further, if the sheet-like part is thick only in the proximity of the fixing parts and there is a step due to a difference in level of the thickness, the sheet-like part is easily deformed at the step and it is difficult to allow the sheet-like part to follow the vibration of the diaphragm 2 smoothly. Therefore, it is necessary to increase the thickness continuously from the thin part A toward the both ends.

A ratio of the thickness t1 of the thin part A, the thickness t2 at the side of the outer fixing part 11 and the thickness t3 at the side of the inner fixing part 12 varies with a size and kind of a speaker and also depends on the formation of the convex portions as the control parts explained below. A ratio of t1:t2 is approximately 1:1.2 to 1:7, preferably 1:1.5 to 1:4.

Then, the reason why the formed convex portions serve as control parts is explained below. For example, when the protruded portion 14 is formed as shown in the control part S2 of FIG. 1C, it serves for inhibiting the bending of the sheet-like part 13 against both of a downward force and an upward force in FIG. 1C. Therefore, the protruded portion 14 serves as a control part for the bending in both of the upward and downward directions. However, even if the protruded portion 14 is not formed and an arc portion Q2 in a downward convex shape is formed by eliminating a corner part of the protruded portion 14 as shown by a dotted line in FIG. 1C, inhibition of downward bending can be controlled. Namely, generally in the case of a bent in the form of arc, when a bending force is applied toward the inner side of the arc, the arc is bent comparatively easily and inhibition of the bending is hardly exhibited. However, when a bending force is applied toward the outer side of the arc opposite to the inner side of the arc, the bending force is applied in the direction of the outer side of the arc, and therefore, the arc hardly bends. Namely, the force inhibiting the bending works easily and the vibration can be controlled more. Therefore, even in the case of the above-mentioned arc shape Q2 shown by the dotted line, the force to be applied downward in the drawing can be controlled.

On the other hand, in the control part S1, the sheet-like part 13 having a semi-circular arc portion Q1 in the form of upward convex leads to the outer fixing part 11, and therefore, similarly to the above explanation on the arc portion Q2, inhibition of a force directing to the inside of the arc cannot be expected so much, but inhibition of a force directing to the outside of the arc is exhibited greatly. Therefore, at the outer fixing part 11 side shown in FIG. 1C, the control part S1 at the upper side can control an upward force and the control part S2 at the lower side can control a downward force (in the case of the arc portion Q2), or the both of the upward force and the downward force can be controlled (in the case of the protruded portion 14). Thus the vibration can be controlled completely by the control parts S1 and S2. The above explanation is made for a significantly representative case, and in each of the control parts S1 and S2, not only control of a force in one direction but also control of a force in a reverse direction can be made especially when the thickness of the sheet-like part is made thick.

Further, the control part S3 at the inner fixing part 12 side of the edge 1 shown in FIG. 1C is explained below. At the inner fixing part 12 side of the sheet-like part 13, there is an arc portion Q3 which is formed with an arc R2 or R3 having a smaller radius than that of an arc R1 of the arc portion Q1 formed in a semi-circular shape and is in a direction reverse to the arc R1. Thus the sheet-like part 13 leads to the inner fixing part 12 with the arc portion Q3 being disposed therebetween. As a result, in the same manner as in the above-mentioned control action of the arc portion Q2, since the arc portion Q3 is in a downward convex shape as shown in FIG. 1C, vibration due to a downward force is easily controlled and the arc portion Q3 serves as a control part S3. In this case, a sufficient controlling force is not always exhibited against an upward force, but since the thickness of the sheet-like part 13 is large, a controlling force is exhibited, and also, an excessive vibration of the diaphragm 2 can be inhibited with such a shape of the arc portion Q3 even if a damper is not used since the control parts S1 and S2 at the outer fixing part 11 have a larger action for controlling the vibration of the diaphragm 2.

Namely, in the edge 1 of the presently disclosed embodiment shown in FIGS. 1A to 1C, the sheet-like part 13 has a semi-circular arc shape Q1 in its cross-section and at the boundary portion of the sheet-like part 13 and the outer fixing part 11, the convex surface of the sheet-like part 13 leads to the vertical surface 11*a* of the outer fixing part 11 without changing the direction of the convex arc. The opposite surface of the sheet-like part extends in parallel with the vertical surface 11*a* of the outer fixing part 11 and leads to the outer fixing part 11 to be in the same level as a bottom face 11*b* of the outer fixing part, thereby forming a protruded portion 14. This protruded portion may be the arc portion Q2 (shown by the dotted line in the drawing) in the form of arc reverse to the convex arc R1. Also, at the boundary portion of the sheet-like part 13 and the inner fixing part 12, the both of the outer surface of the arc portion Q1 and the inner surface opposite thereto face toward a direction reverse to the arc R1 of the arc portion Q1, and are formed into the arc portion Q3 bent so as to have a smaller arc (radius) R2 and R3. As shown, these smaller arcs R2 and R3 may have the same radius or different radiuses, or the surfaces of the arcs R2 and R3 may be in parallel with each other or may not be in parallel with each other. It is the direction of the arc that is important.

This edge 1 is formed into a ring shape as shown in a perspective view of FIG. 1B. This ring is formed in the circular shape in FIG. 1B, but may be in an elliptical or track shape and the edge is formed according to the form of a speaker.

This edge 1 can be produced by molding, for example, a resin material with elasticity such as an elastomer in a mold. Therefore, the edge 1 can be produced by making a mold according to a desired speaker and transferring the material into the mold, thereby making the production easy, and can be formed into a shape having an arc and a shape having a gradually changing thickness, in which the thickness can be strictly controlled, or into a circular shape, an elliptical shape or a track shape. The material needs to have elasticity, and is preferably one having durability, and the above-mentioned elastomer is most preferred.

The speaker having such an edge can be formed into a structure as shown in FIG. 1A. Namely, the voice coil 4 is wound at one end side of the outer circumference of the bobbin 3, and at the center of the one end (bottom) side of the bobbin 3, the magnetic circuit 7 having the permanent magnet 7*a* and the yoke 7*b* is formed so as to generate a magnetic field. The frame 6 is provided outside the bobbin 3, and the outer fixing part 11 of the edge 1 is fixed to the top end portion of the frame 6, and the outer peripheral end of the diaphragm 2 in the form of ring is fixed to the inner fixing part 12. The inner peripheral part of the diaphragm 2 is fixed to the outer circumference of the bobbin 3. Namely, the speaker shown in FIG. 1A is the same as a usual electrodynamic speaker having a driving part except for the shape of the edge 1, and is then briefly explained below. In addition, the frame 6 is formed from a resin or a metal plate.

Figure 5:
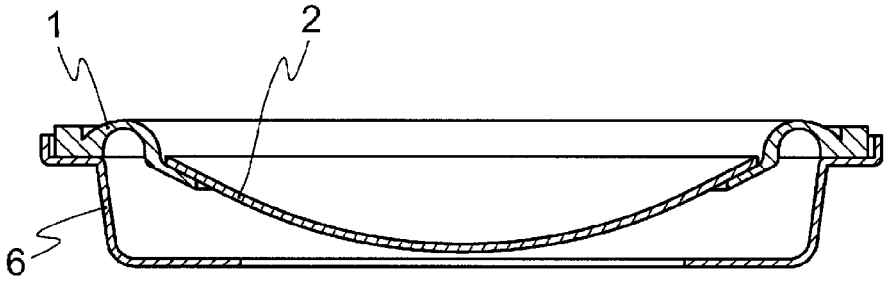
FIG. 5 is a cross-sectional view illustrating another aspect of the speaker of the presently disclosed embodiment.
Figure 6A:
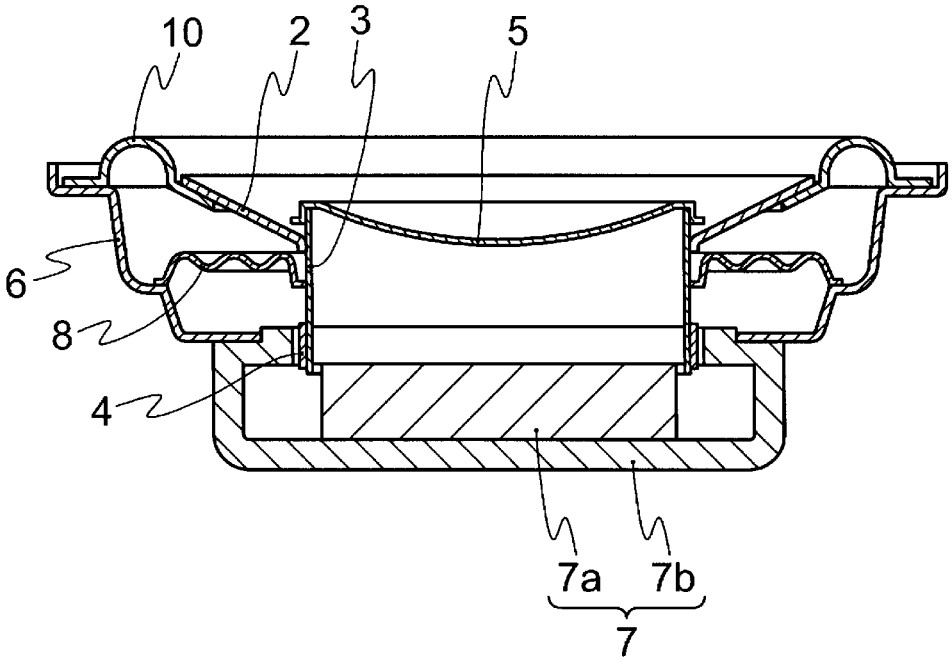
FIG. 6A is a cross-sectional view illustrating one example of a conventional speaker.
Figure 6B:
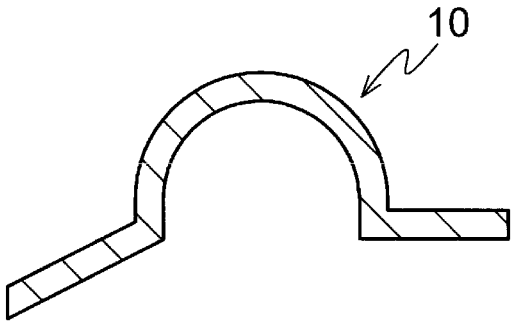
FIG. 6B is a cross-sectional view illustrating an edge of FIG. 6A.

For example, a paper, wood, a woven fabric using a fiber, a knitted fabric using a fiber, a non-woven fabric and a woven fabric using a fiber which are impregnated with a bonding resin comprising a silicone resin, a metal material, a synthetic resin, an acrylic foam, a hybrid material comprising a synthetic resin and a metal, and the like can be used on the diaphragm 2. This diaphragm 2 may comprise a plurality of layers. In the example shown in FIG. 1A, the speaker is of a cone type and therefore, the diaphragm is in the form of ring and a driving part is formed at the center thereof. However, the diaphragm may be in the form of dome, and the bobbin 3 may be adhered to the back surface thereof. Also, as shown in FIG. 5 to be explained infra, in the case of a passive radiator type speaker, the diaphragm 2 is not in the form of ring and is in a shape of dome or plate formed up to the center of the speaker. The outer shape of this diaphragm 2 has a planar structure, and is formed into a shape according to its purpose such as a circular, elliptical, or track shape.

The bobbin 3 is in a cylindrical shape formed from a resin, metal, paper or the like, and the voice coil 4 is wound on the outer circumference of the bobbin 3 at its one end so that a magnetic field is generated in the voice coil 4 by electromagnetic induction due to a current change of a sound signal. Also, at another end side of the bobbin 3, a dust cap 5 is provided to close the end portion of the bobbin 3. Further, the inner peripheral end of the above-mentioned diaphragm 2 is fixed to the outer circumference of the another end side of the bobbin 3. In addition, in the example shown in FIG. 1A, the dust cap 5 is in the form of a concave cap, but can be formed into a convex shape. Further, in FIG. 1A, a lead, etc. for connecting to the voice coil 4 are omitted.

At the one end side of the bobbin 3, the magnet 7*a* and the yoke 7*b* are provided to form the magnetic circuit 7 for generating a magnetic field inside the bobbin 3. In addition, in FIG. 1A, the sheet-like magnet 7*a* is provided, but a magnet in the form of ring can be formed coaxially with the bobbin 3.

Shown in FIG. 1A is an example of an electrodynamic speaker (a speaker having a driving part), and the edge of the presently disclosed embodiment can be used on a passive radiator type speaker as shown in FIG. 5. In FIG. 5, there is no driving part such as a bobbin, a voice coil and a magnetic circuit, and the diaphragm 2 is formed in a dome or plate shape with the diaphragm being provided up to the center of the speaker. Other configuration is the same as in FIG. 1A, and therefore explanation thereof is omitted. In this passive radiator type speaker, for example, it is arranged in a closed chamber together with an electrodynamic speaker as shown in FIG. 1, and the passive type speaker is vibrated by the vibration of the electrodynamic speaker.

Figure 2:
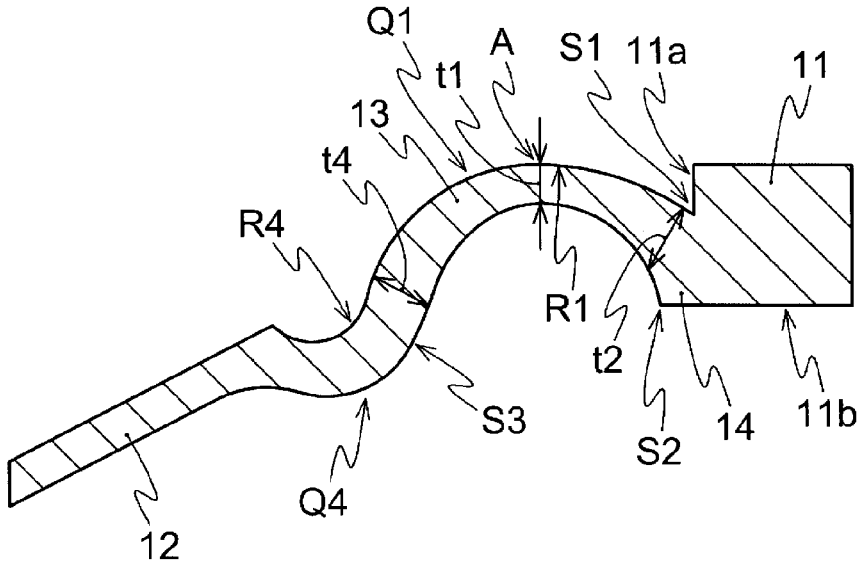
FIG. 2 is a cross-sectional view illustrating another aspect of the edge of the presently disclosed embodiment.

Next, another aspect of the edge of the presently disclosed embodiment is explained below. FIG. 2 is a cross-sectional view similar to FIG. 1C illustrating another example of the edge for a speaker of the presently disclosed embodiment. Namely in the aspect shown in FIG. 2, the edge is in an S-shape formed from a large arc portion Q1 of the sheet-like part 13 having a semi-circular shape in its cross-section and a small arc portion Q4 facing in a direction reverse to the arc R1 of the large arc portion Q1 and having a small arc R4. The thinnest part A is formed substantially at the center of the large arc portion Q1. The structure of the boundary portion of the sheet-like part 13 and the outer fixing part 11 is the same as the structure shown in FIG. 1C, and the upper convex surface of the large arc portion Q1 leads to the vertical surface 11*a* of the outer fixing part 11 without changing the direction of the convex arc R1 to form a first control part S1. The surface opposite to the upper convex surface of the sheet-like part extends in parallel with the vertical surface 11*a* of the outer fixing part 11 and leads to the outer fixing part 11 to be in the same level as a bottom face 11*b* of the outer fixing part, thereby forming a protruded portion 14. Thus a second control part S2 is formed. This second control part S2 can lead to the outer fixing part 11 in the form of arc reverse to the convex arc R1 as shown by the arc portion Q2 in FIG. 1C. At the boundary portion of the sheet-like part 13 and the inner fixing part 12, the both of the outer surface of the arc portion Q1 and the inner surface opposite thereto lead to the inner fixing part 12 with the arc R4 of the arc portion Q4 being smaller than the large arc portion Q1 and being bent in a direction reverse to the large arc portion Q1. Thus a third control part S3 is formed.

Namely, the structure as shown in FIG. 2 is nearly the same as that shown in FIG. 1A only except that the arc portion Q4 of the control part S3 is larger than the arc portion Q3 of FIG. 1C. In the structure shown in this FIG. 2, too, the whole of this small arc portion Q4 acts as the third control part S3. In addition, a thickness t4 of the sheet-like part 13 at the inner fixing part 12 side may be the same as the thickness t3 in the example shown in FIG. 1C.

Figure 3:
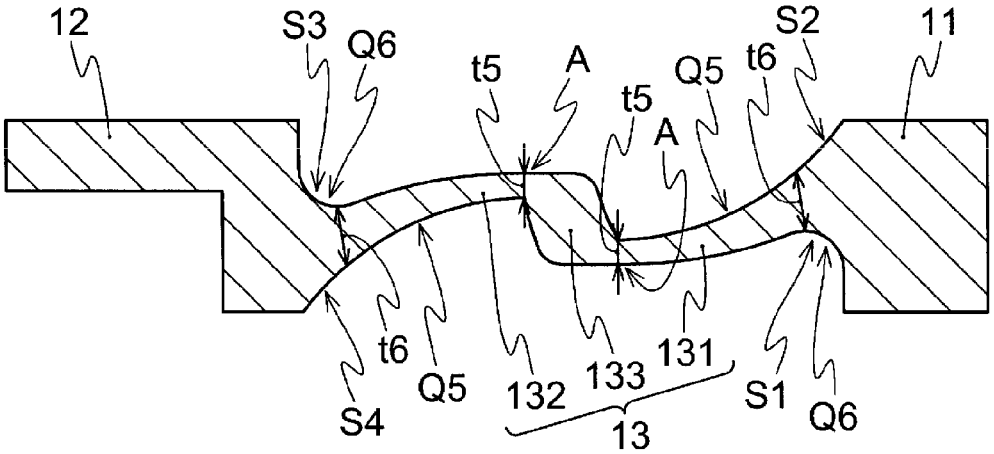
FIG. 3 is a cross-sectional view illustrating other aspects of the edge of the presently disclosed embodiment.

FIG. 3 is similar to FIG. 2 showing other aspects of the edge 1 of the presently disclosed embodiment. Namely, the sheet-like part 13 has a first arc portion 131 and a second arc portion 132, each being in a similar shape and having an arc portion Q5, and is formed such that each of one end sides A thereof is thin (t5) and each of other end sides thereof is thick (t6), and arc portions being reverse to the arc portion Q5 and having a radius smaller than that of the arc portion Q5 are formed on the convex surfaces at the other end sides. A connecting portion 133 is disposed between the first arc portion 131 and the second arc portion 132 in such a manner that the arcs of the arc portion Q5 are reverse to each other. The two thin parts A at the both sides of the connecting portion 133 correspond to the thin part A of the sheet-like part 13. The sheet-like part 13 is formed such that the other end side of the first arc portion 131 leads to the outer fixing part 11 and the other end side of the second arc portion 132 leads to the inner fixing part 12.

Even in the case of the structure as mentioned above, the respective arc portions Q6 having a smaller radius and being reverse to each other are formed on the convex surfaces of the first arc portion 131 and the second arc portion 132, and therefore, at the boundary portion of the sheet-like part 13 and the outer fixing part 11, convex portions facing reverse directions are formed on the both surfaces of the sheet-like part 13. Accordingly, for example, at the outer fixing part 11 side, when an upward force acts on the edge 1, it is a force for extending the arc portion Q6 on the lower surface toward the outside, and an action of a first control part S1 for inhibiting this upward force is exhibited. Further, when a downward force acts on the edge 1, since the upper surface of the sheet-like part at the boundary portion of the sheet-like part and the outer fixing part 11 is in the convex shape in the downward direction, the downward force is a force for extending the arc portion toward the outside, and therefore, an action of a second control part S2 for inhibiting such a downward force is exhibited. Similarly, at the boundary portion of the sheet-like part 13 and the inner fixing part 12, the upper surface of the sheet-like part acts as a third control part S3 for inhibiting a downward force on the edge 1, and the lower surface of the sheet-like part acts as a fourth control part S4 for inhibiting an upward force on the edge 1, respectively. As a result, in the same manner as in the structure shown in FIG. 1C, the amplitude of the edge 1 due to a small vibration of the diaphragm 2 is followed by the bending of the thin part A, and for the excessive amplitude of the edge 1 due to a large vibration having an inertial force, an excessive amplitude can be inhibited. Namely, in the same manner as in the structure shown in FIG. 1C, the edge can follow normal vibration of the diaphragm 2 while an excessive vibration is inhibited. In addition, the connecting portion 133 does not serve as a control part.

Figure 4:
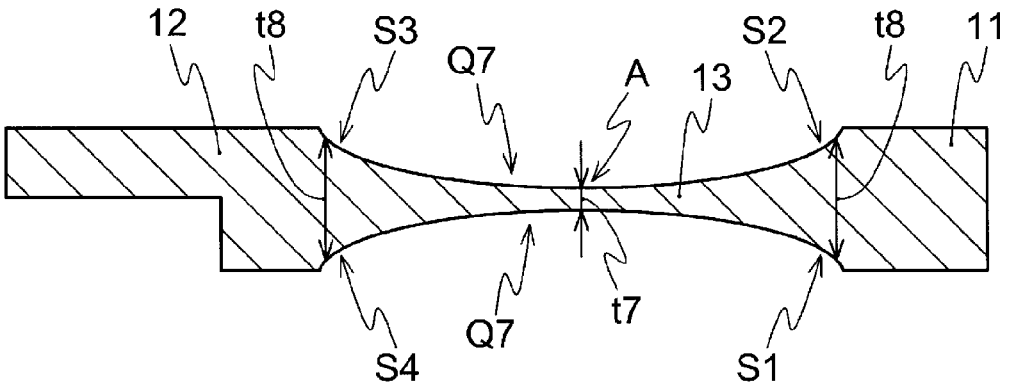
FIG. 4 is a cross-sectional view illustrating still other aspects of the edge of the presently disclosed embodiment.

FIG. 4 is a cross-sectional view illustrating a further aspect of the edge 1 of the presently disclosed embodiment. Namely, in the edge 1 shown in FIG. 4, the sheet-like part 13 is nearly in a plate shape, and in the drawing, arc portions Q7 having concave arc surfaces on both sides thereof are formed so that a nearly center part thereof is the thin part A. The both ends of the sheet-like part 13 lead to the outer fixing part 11 and the inner fixing part 12, respectively.

Even in such a structure, similarly to the above-mentioned explanation, downward convex portions are formed on the upper surface of the sheet-like part 13, and upward convex portions are formed on the lower surface of the sheet-like part 13. Since the opposite convex portions are formed on the both surfaces, the edge has a function of inhibiting either of large upward and downward forces and has the first to fourth control parts S1 to S4 serving for controlling vibration of the diaphragm 2.

EXPLANATION OF SYMBOLS

1 Edge
2 Diaphragm
3 Bobbin
4 Voice coil
5 Dust cap
6 Frame (supporting member)
7 Magnetic circuit

7*a* Magnet
7*b* Yoke
11 Outer fixing part
12 Inner fixing part
13 Sheet-like part
14 Protruded portion
A Thin part
Q1-Q7 Arc portions
S1-S4 Control parts

What is claimed is:

1. An edge of a speaker which is in a sheet-like and ring form and is disposed between a diaphragm of the speaker and a frame for fixing the diaphragm to the frame, the edge comprising:

an outer fixing part formed on an outer peripheral part for fixing to the frame, an inner fixing part formed on an inner peripheral part for fixing to the diaphragm, and a sheet-like part connecting the inner fixing part and the outer fixing part, wherein the sheet-like part has the thinnest part in its cross-section between the inner fixing part and the outer fixing part and is formed in such a manner that the thickness of the sheet-like part increases continuously in directions from the thinnest part to the inner fixing part and the outer fixing part, respectively, the sheet-like part has a semi-circular arc shape in its cross-section, in a boundary portion between the sheet-like part and the outer fixing part, the boundary portion is formed in such a manner that a surface of a convex side of the sheet-like part in the form of arc leads to a vertical surface of the outer fixing part at a higher point of the vertical surface and that a surface opposite to the convex side extends in parallel with the vertical surface of the outer fixing part to form a protruded portion and is in the same level as the bottom of the outer fixing part, or the surface opposite to the convex side is formed into an arc shape reverse to a convex direction of the arc shape of the convex side and leads to the outer fixing part, and thereby a control part for controlling vibration of the diaphragm is formed at least at the boundary portion between the sheet-like part and the outer fixing part.

2. The edge of a speaker of claim 1, wherein in a boundary portion between the sheet-like part and the inner fixing part, both of arc shapes of the surface of the convex side and the surface opposite to the convex side are reverse arc shape to the arc shape of the convex side of the sheet-like part, and a radius of the reverse arc shape is smaller than that of the arc of the sheet-like part.

3. The edge of a speaker of claim 1, wherein a boundary portion of the sheet-like part and the inner fixing part is formed in a reverse arc shape to the semi-circular shape of the sheet-like part and having a smaller radius than that of the arc of the sheet-like part, the reverse arc shape and the semi-circular shape forming an S-shape; the thinnest part is formed substantially at the center of the semi-circular arc shape; and the boundary portion of the sheet-like part and the inner fixing part is formed being bent with the arc having the smaller radius.

4. An edge of a speaker which is in a sheet-like and ring form and is disposed between a diaphragm of the speaker and a frame for fixing the diaphragm to the frame, the edge comprising:

an outer fixing part formed on an outer peripheral part for fixing to the frame, an inner fixing part formed on an inner peripheral part for fixing to the diaphragm, and a sheet-like part connecting the inner periphery part and the outer periphery part, wherein the sheet-like part comprises a first arc portion, a second arc portion and a connecting portion, one end of each of the first arc portion and the second arc portion is defined as a thin part, and the first arc portion and the second arc portion are formed so as to be in arc shapes in such a manner that the thickness thereof increases continuously in directions from the thin part to the other ends, respectively, the other ends of the surfaces of the convex sides of the arc shapes are bent in an arc shape having a small radius and being reverse shape to each of the arc shapes, respectively, the connecting portion leads to the one ends of the first arc portion and the second arc portion so that the arc shapes of the first arc portion and the second arc portion face toward reverse directions, and the other ends of the first arc portion and the second arc portion lead to the outer fixing part and the inner fixing part, respectively.

5. A speaker comprising:

a voice coil wound on the outer circumference of a bobbin, a magnetic circuit generating a magnetic field in a center portion of the voice coil, an edge, an outer fixing part of which is fixed to the frame, a diaphragm, an outer peripheral end of which is fixed to an inner fixing part of the edge, the bobbin which is fixed to a back surface of the diaphragm or to an inner peripheral end of the diaphragm formed in a shape of ring, and a frame provided outside the bobbin, wherein the edge comprises:

an outer fixing part formed on an outer peripheral part for fixing to the frame;

an inner fixing part formed on an inner peripheral part for fixing to the diaphragm, and a sheet-like part connecting the inner fixing part and the outer fixing part, wherein the sheet-like part has the thinnest part in its cross-section between the inner fixing part and the outer fixing part and is formed in such a manner that the thickness of the sheet-like part increases continuously in directions from the thinnest part to the inner fixing part and the outer fixing part, respectively, the sheet-like part has a semi-circular arc shape in its cross-section, in a boundary portion between the sheet-like part and the outer fixing part, the boundary portion is formed in such a manner that a surface of a convex side of the sheet-like part in the form of arc leads to a vertical surface of the outer fixing part at a higher point of the vertical surface and that a surface opposite to the convex side extends in parallel with the vertical surface of the outer fixing part to form a protruded portion and is in the same level as the bottom of the outer fixing part, or the surface opposite to the convex side is formed into an arc shape reverse to a convex direction of the arc shape of the convex side and leads to the outer fixing part, and thereby a control part for controlling vibration of the diaphragm is formed at least at the boundary portion between the sheet-like part and the outer fixing part.

6. A speaker comprising:

a voice coil wound on the outer circumference of a bobbin, a magnetic circuit generating a magnetic field in a center portion of the voice coil, an edge, an outer fixing part of which is fixed to the frame, a diaphragm, an outer peripheral end of which is fixed to an inner fixing part of the edge, the bobbin which is fixed to a back surface of the diaphragm or to an inner peripheral end of the diaphragm formed in a shape of ring, and a frame provided outside the bobbin, wherein the edge comprises:

an outer fixing part formed on an outer peripheral part for fixing to the frame, an inner fixing part formed on an inner peripheral part for fixing to the diaphragm, and a sheet-like part connecting the inner periphery part and the outer periphery part, wherein the sheet-like part comprises a first arc portion, a second arc and a connecting portion, one end of each of the first arc portion and the second arc portion is defined as a thin part, and the first arc portion and the second arc portion are formed so as to be in arc shapes in such a manner that the thickness thereof increases continuously in directions from the thin part to other ends, respectively, the other ends of the surfaces of the convex sides of the arc shapes are bent in an arc shape having a small radius and being reverse shape to each of the arc shapes, respectively, the connecting portion leads to the one ends of the first arc portion and the second arc portion so that the arc shapes of the first arc portion and the second arc portion face toward reverse directions, and the other ends of the first arc portion and the second arc portion lead to the outer fixing part and the inner fixing part, respectively.

7. A speaker being a passive radiator type speaker comprising:

a frame, an edge, an outer fixing part of which is fixed to the frame, and a diaphragm, an outer peripheral end of which is fixed to an inner fixing part of the edge, wherein the edge comprises:

an outer fixing part formed on an outer peripheral part for fixing to the frame, an inner fixing part formed on an inner peripheral part for fixing to the diaphragm, and a sheet-like part connecting the inner fixing part and the outer fixing part, wherein the sheet-like part has the thinnest part in its cross-section between the inner fixing part and the outer fixing part and is formed in such a manner that the thickness of the sheet-like part increases continuously in directions from the thinnest part to the inner fixing part and the outer fixing part, respectively, the sheet-like part has a semi-circular arc shape in its cross-section, in a boundary portion between the sheet-like part and the outer fixing part, the boundary portion is formed in such a manner that a surface of a convex side of the sheet-like part in the form of arc leads to a vertical surface of the outer fixing part at a higher point of the vertical surface and that a surface opposite to the convex side extends in parallel with the vertical surface of the outer fixing part to form a protruded portion and is in the same level as the bottom of the outer fixing part, or the surface opposite to the convex side is formed into an arc shape reverse to a convex direction of the arc shape of the convex side and leads to the outer fixing part, and thereby a control part for controlling vibration of the diaphragm is formed at least at the boundary portion between the sheet-like part and the outer fixing part.

8. A speaker being a passive radiator type speaker comprising:

a frame, an edge, an outer fixing part of which is fixed to the frame, and a diaphragm, an outer peripheral end of which is fixed to an inner fixing part of the edge, wherein the edge comprises:

an outer fixing part formed on an outer peripheral part for fixing to the frame, an inner fixing part formed on an inner peripheral part for fixing to the diaphragm, and a sheet-like part connecting the inner periphery part and the outer periphery part, wherein the sheet-like part comprises a first arc portion, a second arc portion and a connecting portion, one end of each of the first arc portion and the second arc portion is defined as a thin part, and the first arc portion and the second arc portion are formed so as to be in arc shapes in such a manner that the thickness thereof increases continuously in directions from the thin part to the other ends, respectively, the other ends of the surfaces of the convex sides of the arc shapes are bent in an arc shape having a small radius and being reverse shape to each of the arc shapes, respectively, the connecting portion leads to the one ends of the first arc portion and the second arc portion so that the arc shapes of the first arc portion and the second arc portion face toward reverse directions, and the other ends of the first arc portion and the second arc portion lead to the outer fixing part and the inner fixing part, respectively.

* * * * *